US008701706B2

(12) United States Patent
Schmidt et al.

(10) Patent No.: US 8,701,706 B2
(45) Date of Patent: Apr. 22, 2014

(54) VALVE ARRANGEMENT

(75) Inventors: Matthias Schmidt, Frankfurt (DE); Franz-Josef Körber, Altenstadt (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/474,180

(22) Filed: May 17, 2012

(65) Prior Publication Data

US 2012/0273700 A1 Nov. 1, 2012

Related U.S. Application Data

(63) Continuation of application No. PCT/EP2010/067919, filed on Nov. 22, 2010.

(30) Foreign Application Priority Data

Nov. 20, 2009 (DE) ..... 10 2009 053 899

(51) Int. Cl.
*F15B 20/00* (2006.01)

(52) U.S. Cl.
USPC ..... 137/596.16; 137/596.14

(58) Field of Classification Search
USPC ..... 137/596, 596.14, 596.15, 596.16
See application file for complete search history.

(56) References Cited

U.S. PATENT DOCUMENTS

| | | | | |
|---|---|---|---|---|
| 2,754,840 A | | 7/1956 | Hicks, Jr. | |
| 3,213,334 A | * | 10/1965 | Haakon Forwald | 335/253 |
| 4,557,180 A | * | 12/1985 | Glomeau | 91/446 |
| 5,440,967 A | * | 8/1995 | Wennerbo | 91/471 |
| 5,476,030 A | | 12/1995 | Plettner | |
| 6,595,104 B2 | * | 7/2003 | Pinciaro | 91/461 |
| 7,891,375 B2 | * | 2/2011 | Decker | 137/596.15 |

FOREIGN PATENT DOCUMENTS

| | | | |
|---|---|---|---|
| DE | 1 138 595 | B | 10/1962 |
| DE | 1 284 230 | B | 4/1963 |
| DE | 2 311 354 | A1 | 9/1974 |
| DE | 28 50 590 | A1 | 5/1979 |
| DE | 199 32 139 | A1 | 1/2001 |
| DE | 2009 014 421 | A1 | 9/2010 |
| GB | 1598332 | * | 2/1978 |

OTHER PUBLICATIONS

International Search Report (PCT/ISA/210) issued on Feb. 4, 2011, by the European Patent Office as the International Searching Authority for International Application No. PCT/EP2010/067919.

* cited by examiner

*Primary Examiner* — Craig Schneider
*Assistant Examiner* — Umashankar Venkatesan
(74) *Attorney, Agent, or Firm* — Buchanan Ingersoll & Rooney PC

(57) ABSTRACT

Exemplary embodiments relate to a valve arrangement for actuating a piston cylinder arrangement, that includes a pilot control valve arrangement and a main control valve arrangement, wherein both the pilot control and main control valve arrangement include a 3/2-way valve as a pilot control valve and as a main control valve. Each valve has a control-pressure, high-pressure, and low-pressure connection. Said connections are connected to each other such that the main control valve is controlled via the control-pressure connection of the pilot control valve and the pressures on the control-pressure connection of the pilot control valve and the pressures on the control-pressure connection and on the high-pressure connection of both valves, are statically inverted relative to each other. The 3/2-way valves are designed as seat valves and are only hydraulically connected to each other.

9 Claims, 3 Drawing Sheets

VALVE ARRANGEMENT

RELATED APPLICATION

This application claims priority as a continuation application under 35 U.S.C. §120 to PCT/EP2010/067919, which was filed as an International Application on Nov. 22, 2010 designating the U.S., and which claims priority to European Application 102009053899.2 filed in Europe on Nov. 20, 2009. The entire contents of these applications are hereby incorporated by reference in their entireties.

FIELD

The invention relates to a circuit breaker, such as, a valve arrangement with a prior control valve arrangement and with a main control valve arrangement for activating a piston/cylinder arrangement, in particular for actuating the movable contact piece of a high-voltage circuit breaker.

BACKGROUND

DE 10 2009 014 421.8 proposes a valve arrangement in which a 3/2-way valve is provided as a pilot control valve and two 2/2-way valves are provided as a main control valve arrangement.

U.S. Pat. No. 5,476,030 A discloses a valve arrangement having a plurality of valves of different type of construction with a plurality of 2/2-way valves and with a 3/2-way valve, the set-up of the valve arrangement therefore being highly complicated.

DE 199 32 139 B 4 discloses a valve arrangement of the type initially mentioned, in which two slide valves are provided, which are connected to one another in the way initially mentioned and are intended for the continuous regulation of a pressure. Both valves include a spring return, the pilot control valve having an exciter system. Because of the structural configuration of the slide valves, which is based on the follower piston principle, mechanical coupling of the two valves is afforded insofar as the pilot control valve is formed by a valve body which is arranged within the actual valve slide.

SUMMARY

An exemplary valve arrangement for actuating a piston/cylinder arrangement is disclosed, comprising: a pilot control valve arrangement and a main control valve arrangement, wherein each of the pilot control valve arrangement and the main control valve arrangement is a 3/2-way valve including a pilot control valve and a main control valve, in each case with a control-pressure, a high-pressure and a low-pressure connection which are connected to one another such that the main control valve is activated via the control-pressure connection of the pilot control valve, and the pressures at the control-pressure connection and at the high-pressure connection of the two valves are inverted statically with respect to one another, and wherein the 3/2-way valves are seat valves and are coupled to one another only hydraulically.

An exemplary valve arrangement for actuating a piston/cylinder arrangement is disclosed, comprising: a pilot control valve arrangement having a control-pressure connection, high-pressure connection, and a low-pressure connection; and a main control valve arrangement having corresponding connections to the control-pressure connection, high-pressure connection, and low-pressure connection of the pilot control valve, wherein pressures at the control-pressure connection and at the high-pressure connection of the valves are inverted statically with respect to one another.

BRIEF DESCRIPTION OF THE DRAWINGS

The exemplary embodiments provide further advantageous refinements and improvements which will be explained and described in more detail by means of the following figures which illustrate the exemplary embodiments in which.

DETAILED DESCRIPTION

Exemplary embodiments of the present disclosure provide a valve arrangement, the set-up of which is considerably simplified, while what is to be achieved is that a position, once initiated, is maintained even without a prevailing control signal and even in the event of a pressure loss.

Figure 1:
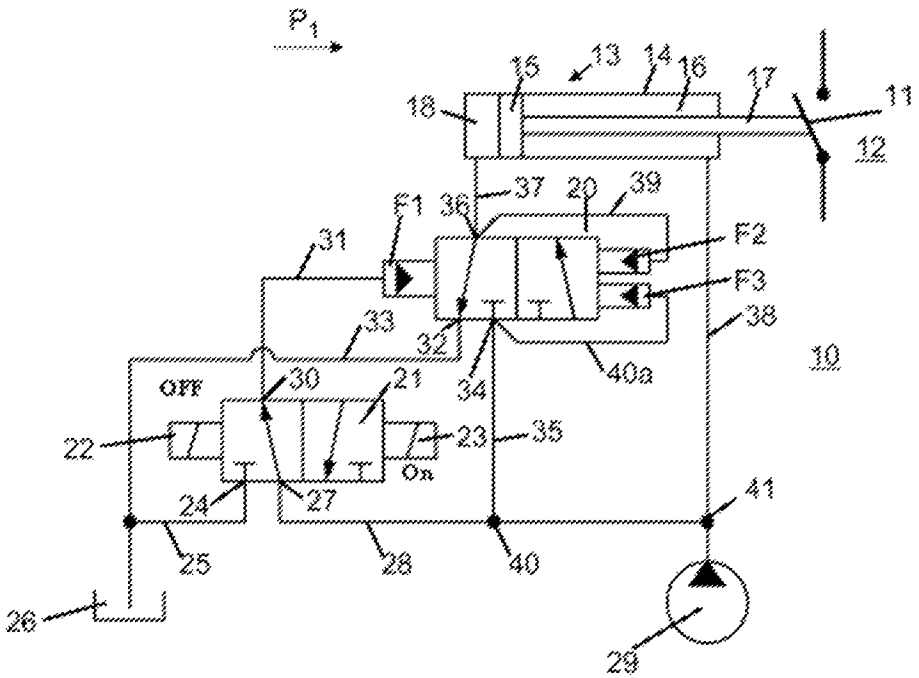
FIG. 1 shows a circuit of a valve arrangement with a switch-off position of the circuit breaker, when the piston rod of the piston/cylinder arrangement is retracted in accordance with an exemplary embodiment.

FIG. 1 shows a circuit of a valve arrangement with a switch-off position of the circuit breaker, when the piston rod of the piston/cylinder arrangement is retracted in accordance with an exemplary embodiment. Exemplary embodiments of the present disclosure include a valve arrangement for actuating a piston/cylinder arrangement, with a pilot control valve arrangement and with a main valve arrangement, the pilot control valve arrangement and the main control valve arrangement containing in each case a 3/2-way valve as a pilot control valve and a main control valve, in each case with a control-pressure, a high-pressure and a low-pressure connection which are connected to one another in such a way that the main control valve is activated via the control-pressure connection of the pilot control valve, and that the pressures at the control-pressure connection and those at the high-pressure connection of the two valves are inverted statically with respect to one another, the 3/2-way valves being designed as seat valves and being coupled to one another only hydraulically.

Consequently, in the static case, the pressures px (=control pressure) and pz (pressure to the piston/cylinder arrangement) of the two 3/2-way valves are inverted with respect to one another. If the control pressure px is at high pressure, the pressure pz is at low pressure, and vice versa. By the two 3/2-way valves being used, the arrangement has long-term stability in the respective switched position, even in the event of leakages.

An advantageous feature of the exemplary embodiments may be that the pilot control valve is assigned in each case a magnetic system for the switching directions. The pilot control valve consequently includes two magnetic systems, specifically one for each switching direction.

In an exemplary embodiment, the main control valve includes three control faces, of which two control faces, a second and a third, can be acted upon with hydraulic fluid in the same direction and the first control face can be acted upon with hydraulic fluid in the opposite direction, the dimensions of the control faces obeying the formula F1>F2+F3. That is to say, the area of the first control face F1 is larger than the sum of the areas of the second and third control faces F2, F3.

When the valve arrangement is used for activating a piston/cylinder arrangement with a piston movable in a cylinder body and with a piston rod connected to said piston, a further advantageous refinement of the exemplary embodiments described herein includes a feature in which the pilot control valve can be activated by the magnetic system such that the first control face of the main control valve is connected to low pressure in a first position of the pilot control valve, with the result that the main control valve is changed over by the second and the third control face acted upon in each case with high-pressure fluid, and the piston of the piston/cylinder arrangement can be moved in the direction of the extension of the piston rod, and the first control face of the main control valve is acted upon with high-pressure fluid in a second position of the pilot control valve, so that the main control valve connects the space above the piston to low pressure, with the result that the piston is acted upon in the direction of the retraction of the piston rod.

Furthermore, exemplary embodiments disclosed herein provide an advantage in that the set-up of the main valve is greatly simplified. The piston serving as a movable part can switch back and forth between the two sealing seats, the piston being moved in one direction by the pressure at the high-pressure connection and in the other direction by the control pressure. The valve therefore can call for only one dynamic soft seal and can therefore be produced markedly more cost-effectively. Also, the pilot control valve can execute a markedly lower stroke than, for example, in the valve arrangement according to DE 19 932 139 B4, because the two valves are coupled hydraulically.

According to an exemplary embodiment of the present disclosure the valve arrangement is bistable, so that a position, once initiated, is maintained even in the event of a pressure loss.

As shown in FIG. 1, the circuit arrangement 10, also called valve arrangement 10, serves for activating the movable contact piece 11 of a high-voltage circuit breaker 12 via a piston/cylinder arrangement 13, in the cylinder 14 of which is arranged movably a piston 15, to whose one side, which delimits the space 16 below the piston 15, a piston rod 17 is connected, which is coupled to the movable contact piece 11 of the circuit breaker 12. Located on the opposite side of the piston 15 is a space 18 above the piston 15, the piston face which delimits this space 18 being larger than that which delimits the space 16 because, there, the piston face is reduced by the amount of the cross-sectional area of the piston rod 17. If, then, hydraulic fluid is pumped into the spaces 16 and 18 both below and above the piston 15, the piston 15 is moved in the direction P1 and the piston rod 17 is moved in the direction of the closing of the movable contact piece 11.

When the space 18 above the piston 15 is relieved, that is to say is connected to a low-pressure reservoir 26 (see below), the pressure inside the space 16 below the piston 15 moves the latter in a direction opposite to the direction of the arrow P1.

FIG. 1 shows the valve arrangement 10 in the position which the piston rod 17 is retracted, that is to say in the position in which the circuit breaker 12 is switched off.

Figure 2:
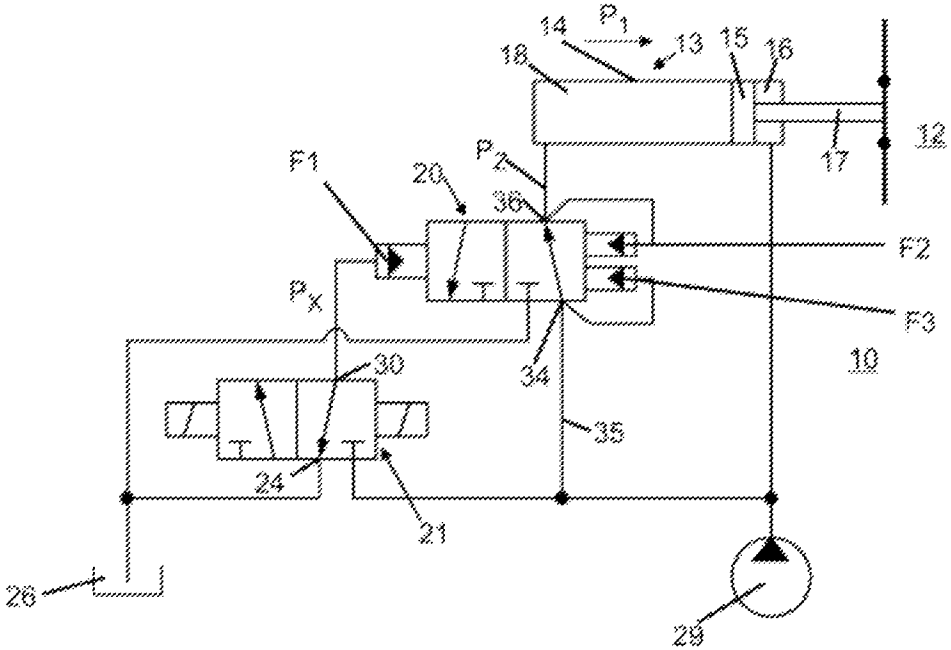
FIG. 2 shows the switch-on position of the circuit breaker when the piston rod is extended in accordance with an exemplary embodiment.

FIG. 2 shows the switch-on position of the circuit breaker when the piston rod is extended in accordance with an exemplary embodiment The valve arrangement 10 includes a main control valve 20 or main valve 20 and a pilot control valve 21.

The pilot control valve 21 is a 3/2-way valve actuable in two directions in each case by means of a magnetic system 22 and 23, one magnetic system 22 actuating the pilot control valve 21 in the "off" direction and the other magnetic system 23 actuating the pilot control valve 21 in the "on" direction, as is explained in more detail further below. "Off" means the switch-off of the circuit breaker and the retraction of the piston rod 17 into the cylinder 14 and "ON" means the switch-on of the circuit breaker 12 and the extension of the piston rod 17. The pilot control valve 21 includes a first connection port 24 which is connected via a first line 25 to a low-pressure reservoir 26. The pilot control valve 21 includes a second connection port 27 which is connected via a second line 28 to a high-pressure reservoir 29 or high-pressure tank, high-pressure pump or the like. A third connection port 30 has adjoining it a third line 31 which is connected to a first control face F1 of the main valve 20 likewise designed as a 3/2-way valve.

The main valve 20 includes, in a similar way to the pilot control valve 21, a first connection port 32 which is likewise connected to the low-pressure tank 26 via a fourth line 33. Connected to a second connection port 34 of the main control valve 20 is a fifth line 35 which is connected to the high-pressure tank or reservoir 29. Connected to a third connection port 36 of the main control valve 20 is a sixth line 37 which connects this connection port to the space 18 above the piston 15. A seventh line 38 connects the space 16 below the piston 15 to the high-pressure reservoir 29. In this case, the lines 28, 35 and 38 are connected to one another, as is illustrated here symbolically in FIG. 1 by the junction points 40 and 41, and to the high-pressure reservoir 29. They are therefore at high pressure. The connection ports 36 and 34 are connected in each case via a return line 39 and 40*a* in each case to a second and third control face F2 and F3, the control faces F1, F2 and F3 being dimensionable according to the formula $$F1>F2+F3$$

This means that the area of the first control face F1 is larger than the sum of the areas of the second and the third control faces F2, F3.

The valve arrangement, then, operates as follows:

In the position illustrated in FIG. 1, the pilot control valve 21 has been brought by means of the one magnetic system 22 into the "off" position in which the space 18 above the piston 15 is connected via the lines 33 and 37 to the low-pressure reservoir 26 and is therefore relieved. As control pressure px=high pressure prevails at the first control face F1, because the pilot control valve 21 has set the connection ports 27 and 30 to passage. The feed pressure pz, which forms the fluid pressure of the space 18 above the piston 15, is at low pressure. High pressure prevails at the third control face F3, whereas low pressure prevails via the return line 39 at the second control face F2.

If, then, the circuit breaker 12 is to be switched on, the piston 15 and the piston rod 17 are to be moved in the direction of the arrow P1, see FIG. 2. For this purpose, the pilot control valve 21 is brought to the "on" position by means of the other magnetic system 23, so that the connection ports 30 and 24 are changed over to passage and therefore the control pressure px is at low pressure. The main control valve 20 is hereby reversed, with the result that the connection port 36 is connected to the connection port 34, so that high-pressure fluid at high pressure is supplied hereby as feed pressure pz=high pressure to the space 18 above the piston 15. The space below the piston 15 is permanently under high pressure and is connected to the high-pressure tank 29. On account of the cross-sectional difference between the piston face above and below the piston 15, the piston 15 and the piston rod 17 are moved in the direction of the arrow P1, so that the circuit breaker 12 is switched on. The control pressure px is at low pressure and the feed pressure pz is at high pressure. The pressures px and pz are in each case inverted statically. When the pressure px=high pressure prevails at the connection port 30 of the pilot control valve 21, the pressure at the first control face $F_1$ is then likewise at high pressure; the pressure pz at the connection port 36 of the main control valve 20 is then at low pressure, and vice versa in the position which is illustrated in FIG. 2.

Figure 3:
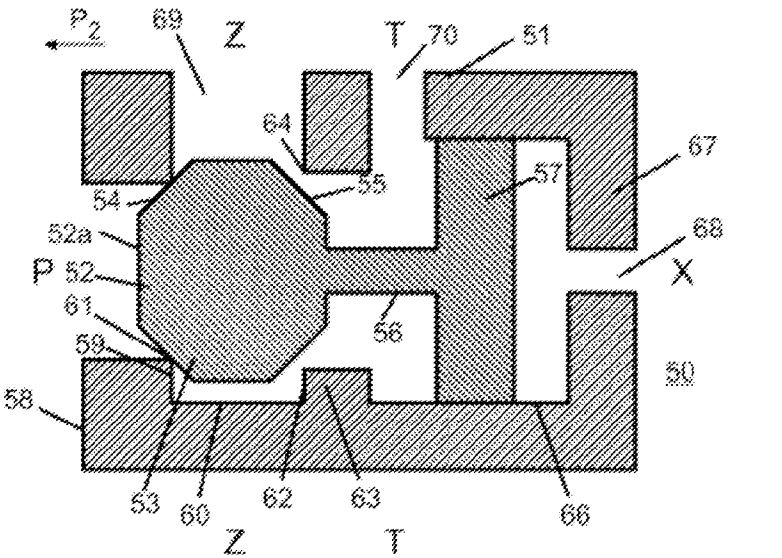
FIG. 3 shows a diagrammatic illustration of a main valve in a first position in accordance with an exemplary embodiment.
Figure 4:
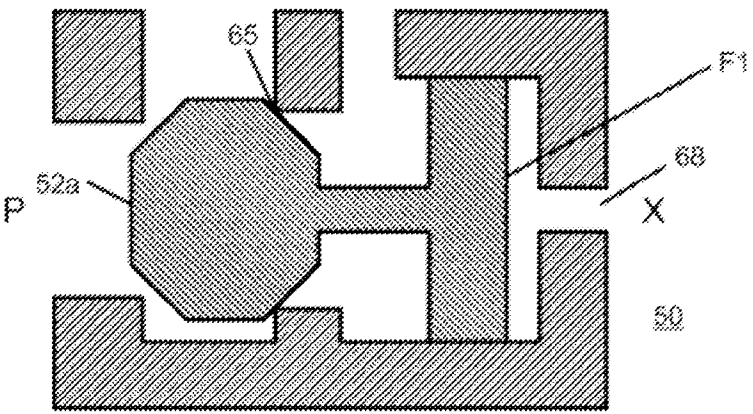
FIG. 4 shows a diagrammatic illustration of a main valve in a second position in accordance with an exemplary embodiment.

Reference will now be made to FIGS. 3 and 4 which show a diagrammatic illustration of a structural refinement of the main control valve 20.

FIG. 3 shows a diagrammatic illustration of a main valve in a first position in accordance with an exemplary embodiment. FIG. 3 shows the main control valve, which here bears the reference numeral 50 in FIGS. 3 and 4, in the position of the main control valve 20 according to FIGS. 1 and 2. FIG. 4 shows a diagrammatic illustration of a main valve in a second position in accordance with an exemplary embodiment.

The main control valve according to FIG. 4 is depicted in the position which the main control valve 20 according to FIG. 2 assumes.

In purely diagrammatic terms, the main control valve 50 of FIGS. 3 and 4 includes a cylinder body 51 in which a piston 52 is received and is movable back and forth. The piston 52 includes a first piston section 53 with two chamfers 54 and 55 arranged at its opposite ends. The first piston section 53 has adjoining it an axially running web 56 on which a second piston section 57 is integrally formed.

The cylinder body 51 includes a first cylinder section 58 which merges via a radial step 59 into a second cylinder section 60 of larger inside diameter, the edge between the inner face of the first cylinder section 58 and the chamfer or oblique face 54 forming a first sealing point 61. The inside diameter of the second cylinder section 60 is larger than the inside diameter of the first cylinder section 58.

The second cylinder section 60 has adjoining it a second radial step 62 which merges into a third cylinder section 63, there being provided between the inner face of the third cylinder section 63 and the step 62 an edge 64 which, in the position in which the piston stands according to FIG. 4, forms together with the oblique face or chamfer 55 a sealing point 65. The inside diameter of the third cylinder section 63 is larger than the inside diameter of the first cylinder section 58 and also smaller than the inside diameter of the second cylinder section 60.

A fourth cylinder section 66 adjoins the third cylinder section 63. The cylinder body 51 includes, adjoining the fourth cylinder section, a bottom 67 which has a through orifice 68. The outside diameter of the second piston section 57 corresponds to the inside diameter of the fourth cylinder section 66.

Furthermore, the cylinder body includes radial holes 69 and 70. The first radial hole 69 is located between the sealing points 61 and 65 and the second radial hole 70 issues into the region between the sealing point 65 and the second piston section 57.

The free face 52*a* of the first piston section 53 is located within the sealing point 61 and is connected permanently to high pressure via the connection port 34, as illustrated by the letter P. The sealing points 61 and 65 are circular.

The first radial hole 69 corresponds to the connection port 36 (see FIGS. 1 and 2) and is connected to the space 18 above the piston. The second radial hole 70 corresponds in this case to the connection port 32 (see FIGS. 1 and 2) and is connected permanently to the low-pressure tank, this being identified by the letter T. The connection of the first radial hole 69 to the space 18 above the piston is symbolized by the letter Z. The second control face F2 illustrated in FIGS. 1 and 2 is formed, for example in the position according to FIG. 3, by the difference in the areas within the sealing points 65 and 61, whereas the third control face F3 illustrated in FIG. 1 and FIG. 2 is formed by the area within the sealing point 61. The return lines 39 and 40*a* are integrated in the main control valve 50 and do not form dedicated line routes. These return lines 39 and 40*a* are illustrated in FIGS. 1 and 2 to make clear how the circuit arrangement operates.

FIG. 3 shows the first main control valve in the position according to FIG. 1. In this case, high pressure prevails at that face of the piston section 57 which interacts with (e.g., confronts) the through orifice 68, so that this face corresponds to the first control face F1. Admittedly, high pressure likewise prevails at the face 52*a* of the first piston section 53; however, since that face of the piston section 57 which interacts with the through orifice 68 is larger than the face 52*a* exposed to the high pressure, the piston 52 is pressed permanently in the direction of the arrow P2, with the result that the sealing point 61 is closed. The space 18 above the piston 15 is at low pressure via the first and the second radial hole 69 and 70.

After reversal, that is to say when low pressure prevails at the first control face F1 which corresponds to that face of the piston 52 or of the second piston section 57 which interacts with the through orifice 68, as is clear from FIG. 2, the piston 52 is then pressed via the face 52*a* opposite to the direction of the arrow P2, so that the sealing point 65 is closed; the path via the then open sealing point 61 is free for high pressure, so that high pressure can be supplied to the space 18 above the piston 52, the result of this being that the piston rod 17 is extended out of the cylinder 14 and the circuit breaker 12 is closed, see FIG. 2.

In the refinement according to the invention, the main valve stage and the pilot valve stage can in each case autonomously hold pressure, so that leakages in one of the valves or the other do not lead to undesirable switching actions.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A valve arrangement for actuating a piston/cylinder arrangement, the valve arrangement comprising:

a pilot control valve arrangement and a main control valve arrangement, wherein each of the pilot control valve arrangement and the main control valve arrangement is a 3/2-way valve including a pilot control valve and a main control valve, in each case with a control-pressure, a high-pressure and a low-pressure connection which are connected to one another such that the main control valve is activated via the control-pressure connection of the pilot control valve, and the pressures at the control-pressure connection and at the high-pressure connection of the two valves are inverted statically with respect to one another, wherein the 3/2-way valves are seat valves and are coupled to one another only hydraulically, and wherein the main control valve has three control faces, of which a second and a third control face, can be acted upon with hydraulic fluid in a same direction, a first control face can be acted upon with hydraulic fluid in an opposite direction, and dimensions of areas of the control faces obey F1>F2+F3.

2. The valve arrangement as claimed in claim 1, wherein the control pressures and feed pressures fed to the piston/cylinder arrangement are inverted with respect to one another in the static case.

3. The valve arrangement as claimed in claim 1 used for activating a piston/cylinder arrangement with a piston movable in a cylinder body and with a piston rod connected to said piston, wherein the pilot control valve can be activated by the magnetic system such that the third control face is connected to low pressure in a first position of the pilot control valve, such that the main control valve is changed over by the first and the second control face acted upon in each case with high-pressure fluid, and the piston of the piston/cylinder arrangement can be moved in a direction of an extension of the piston rod, and the third control face is acted upon with high-pressure fluid in a second position of the pilot control valve, so that the main control valve connects a space above the piston to low pressure, such that the piston is acted upon in a direction of the retraction of the piston rod.

4. The valve arrangement as claimed in claim 2, wherein the main control valve has a piston arrangement which has two piston sections, a first piston section of which cooperates, via chamfers on its opposite piston faces, with a sealing edge in two different positions, an inside diameter of a face of the first piston section which interacts with the high pressure being smaller than an inside diameter of the sealing edge, interacting with the low-pressure connection, of the first piston section, and wherein the second piston section of which has, contacting a bottom of the cylinder body that has a control-pressure orifice, a piston face which serves as a first control face, a sum of a areas which are assigned to the sealing edges being smaller than a face of the second piston section which interacts with the bottom of the cylinder body having the control-pressure orifice.

5. A valve arrangement for actuating a piston/cylinder arrangement, comprising:

a pilot control valve arrangement having a control-pressure connection, high-pressure connection, and a low-pressure connection; and a main control valve arrangement having corresponding connections to the control-pressure connection, high-pressure connection, and low-pressure connection of the pilot control valve, wherein pressures at the control-pressure connection and at the high-pressure connection of the valves are inverted statically with respect to one another, wherein the main control valve has first, second, and third control faces, wherein each of the pilot control valve arrangement and the main control valve arrangement are 3/2 way valves, and wherein the second and third control faces can be acted upon with hydraulic fluid in a same direction, and the first control face can be acted upon with hydraulic fluid in an opposite direction to the second and third control faces.

6. The valve arrangement as claimed in claim 5, wherein dimensions of the areas of the control faces obey F1>F2+F3.

7. The valve arrangement as claimed in claim 5, wherein the control pressures and feed pressures fed to the piston/cylinder arrangement are inverted with respect to one another in the static case.

8. The valve arrangement as claimed in claim 5, wherein the piston/cylinder arrangement includes a piston movable in a cylinder body and a piston rod connected to said piston, and when a magnetic system activates the pilot control valve: the third control face is connected to low pressure in a first position of the pilot control valve, the main control valve is changed over by the first and the second control face acted upon in each case with high-pressure fluid, the piston of the piston/cylinder arrangement can be moved in a direction of an extension of the piston rod, and the third control face is acted upon with high-pressure fluid in a second position of the pilot control valve, so that the main control valve connects a space above the piston to low pressure, such that the piston is acted upon in a direction of a retraction of the piston rod.

9. The valve arrangement as claimed in claim 5, wherein the main control valve includes:

a first piston section that cooperates, via chamfers on its opposite piston faces, with a sealing edge in two different positions, wherein an inside diameter of one face of the first piston section which interacts with high pressure connection being smaller than an inside diameter of the sealing edge interacting with a low-pressure connection of the first piston section, and a second piston section having a piston that contacts a bottom of a cylinder body with a control-pressure orifice face, wherein the piston is a first control face, the sum of areas assigned to the sealing edges being smaller than the first control face of the second piston section which interacts with the bottom of the cylinder body with the control-pressure orifice.

* * * * *